US007314400B2

(12) United States Patent
Fildan et al.

(10) Patent No.: US 7,314,400 B2
(45) Date of Patent: Jan. 1, 2008

(54) BRASSIERE CUP ENHANCER FOR MATERNITY OR SPORTS BRASSIERES

(75) Inventors: Gerhard Fildan, Vienna (AT); Karl Wanzenbök, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 51 days.

(21) Appl. No.: 11/153,227

(22) Filed: Jun. 15, 2005

(65) Prior Publication Data

US 2006/0282934 A1 Dec. 21, 2006

(51) Int. Cl.
*A41C 3/12* (2006.01)
*A41C 3/00* (2006.01)

(52) U.S. Cl. ..... 450/86; 450/88

(58) Field of Classification Search ..... 450/86, 450/88; 2/300, 301, 305, 326–333, 337, 2/338, 340

See application file for complete search history.

(56) References Cited

U.S. PATENT DOCUMENTS 2,063,104 A * 12/1936 Kibbe ..... 450/86
2,753,569 A * 7/1956 Schmalz ..... 2/323
2,849,723 A * 9/1958 Marino ..... 2/323
4,795,400 A * 1/1989 Greenberg ..... 450/86

* cited by examiner

*Primary Examiner*—Gloria M. Hale
(74) *Attorney, Agent, or Firm*—Andrew Wilford

(57) ABSTRACT

A breast enhancer especially for maternity and sports brassieres has a connector at one end joined to a shoulder strap and at the opposite end a connector for engagement with the undercup of the maternity brassiere or a cup of the sports brassiere. The enhancer is in the form of a laminated inelastic strip of a greater width than that of the back strap and can be cushioned to reduce pressure on the wearer. It can be provided with a row of female fasteners cooperating with a male press and hook type fastener to enable adjustment of the cup.

18 Claims, 4 Drawing Sheets

BRASSIERE CUP ENHANCER FOR MATERNITY OR SPORTS BRASSIERES

FIELD OF THE INVENTION

Our present invention relates to maternity and sports brassieres and, more particularly, to a brassiere cup enhancer for use particularly with maternity and sports brassieres but with universal applicability for strap undergarments generally.

BACKGROUND OF THE INVENTION

A brassiere generally comprises a front portion formed with two cups, a back portion connected to the front portion and extending around the back of the wearer and shoulder straps which are connected at the cups and are joined to the back portion. The brassiere may have a front closure between the cups or a back portion joining parts of the back portion together in a releasable manner. The straps generally can be adjustable by buckles or fasteners and can be connected to the cup portions by detachable fasteners.

In maternity brassieres, the front portion may have flaps which are detachably connected to allow a breast to be exposed for nursing generally by releasing a clip securing that flap at the front of the brassiere at the connection between the respective cup portion and the shoulder strap.

In a sports bra, which can have less structured cups, the connector to the strap may be a ring through which the strap can be looped.

In all brassieres of the type described it is desirable to be able to draw the cup upwardly toward the shoulder in an adjustable manner and particularly in nursing brassieres and in sports brassieres, a greater range of adjustability may be desirable. In addition, since the shoulder straps are usually somewhat narrow they may tend to cut into the wearer and limit the comfort of the brassiere.

OBJECTS OF THE INVENTION

It is, therefore, the principal object of the present invention to provide an improved brassiere whereby the drawbacks mentioned can be avoided and comfort is improved.

Another object is to provide a component which can be fitted to existing brassieres and can increase the versatility thereof and particularly the adjustability of the shoulder strap to the cup and vice versa.

Another object of this invention is to provide a brassiere cup enhancer, particularly for nursing or maternity brassieres but also for sports brassieres which will increase the adjustability thereof, improve comfort and provide improved appearance.

SUMMARY OF THE INVENTION

These objects and others which will become apparent hereinafter are attained, in accordance with the invention in a brassiere which comprises:

a brassiere body formed with two cups;

a back portion extending rearwardly from opposite sides of the brassiere body and adapted to extend around a back of a wearer;

respective shoulder straps adapted to support the so cups and connectable to the back portion; and a respective cup enhancer between each shoulder strap and the respective cup, each of the enhancers comprising an elongated flexible strip of a width greater than that of the respective shoulder strap and formed at one end with a connector detachably engageable with the respective strap and at an opposite end with a connector detachably engageable with the respective cup.

Key to that brassiere is the cup enhancer which is capable of being used for maternity or nursing brassieres or sports brassieres, but even for ordinary shoulder strap brassieres, and which comprises:

an elongated flexible strip formed at one end with a connector detachably engageable with a shoulder strap of a brassiere and at an opposite end with a connector detachably engageable with a respective cup of the brassiere.

According to the invention, a seamless, laminated and cushioned shoulder strap component is provided with a row of female fasteners adapted to accommodate male combination press and hook fasteners. The component can be used for maternity brassieres as well as for sports brassieres, usually will be detachable from the frame or body of the brassiere and can be widened with respect to the shoulder strap to prevent cutting into the wearer. The cushioning can be provided by laminating a cushion layer between the upper and lower layers and the two, three or four female fasteners can be integrated in the component toward the end of the component where the breast begins. The opposite end of the component can be connected with an elastic, adjustable shoulder strap in a detachable or fixed manner.

When the unit is applied to a maternity brassiere, the flap can be connected to one or another of the fasteners while the undercup can be connected to the end of the component, thereby increasing the adjustability of the brassiere to a breast which can be full or empty of milk.

According to a feature of the invention, one of the connectors of the cup enhancer is a length of strap adapted to be passed through a ring and secured to a surface of the strip at a selected one of the fasteners and thus is provided at its end with a male combination press and hook fastener.

The connectors at one or both ends may be rings, preferably with an openable and closeable side.

The strip itself is laminated from a pair of coextensive outer layers which are welded together, preferably with the cushioning layer between the outer layers. The cushioning layer may be narrower than the outer layers and can extend over only part of the length of the respective strip.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
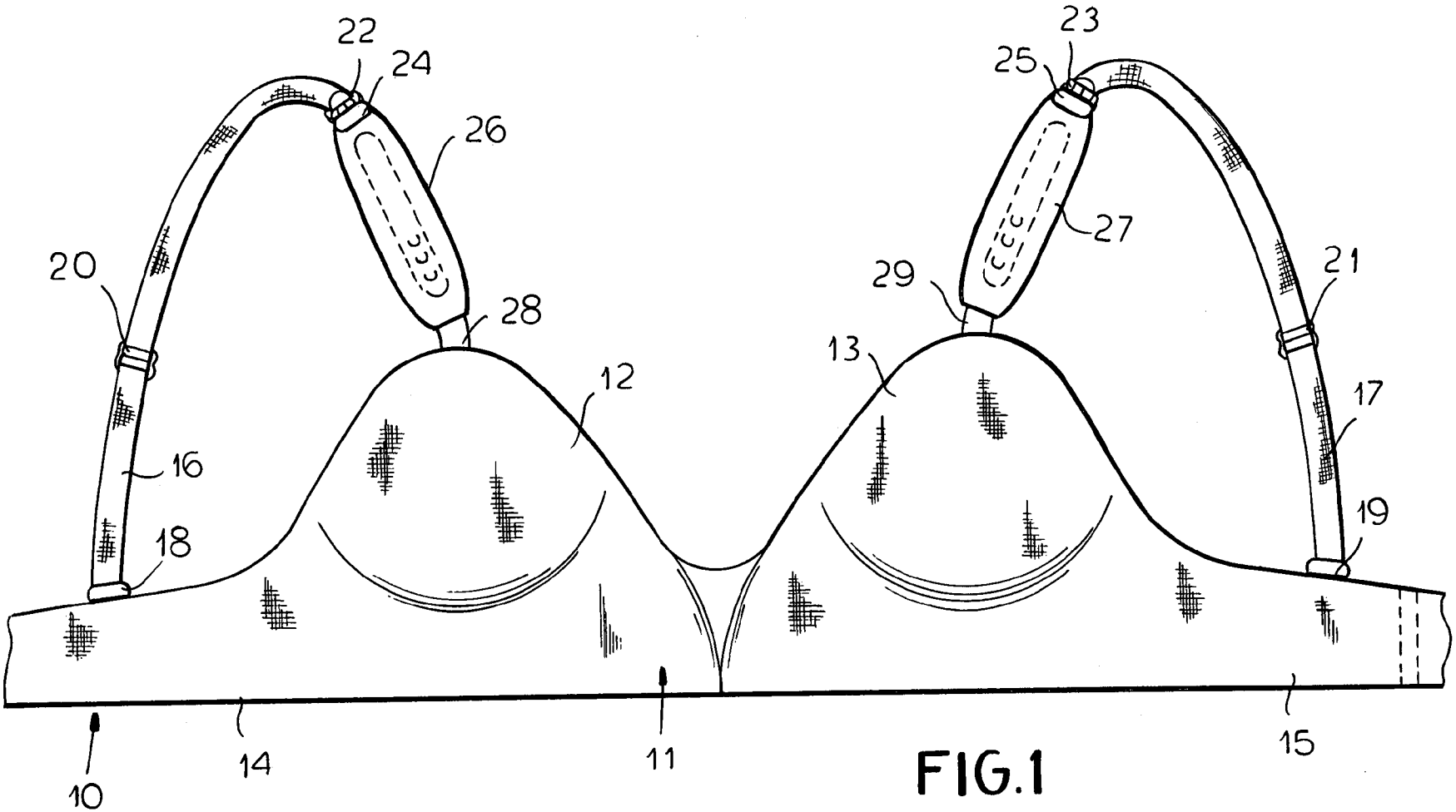
FIG. 1 is a diagrammatic front view of a brassiere showing the cup enhancers of the invention.

A brassiere 10 can, as shown in FIG. 1, comprise a front portion 11 or frame provided with cups 12 and 13, and a back portion formed by wings 14 and 15 which can be interconnected detachedly at the back of the wearer. Shoulder straps 16 and 17 can have hooks 18 and 19 engaged in loops of the wings 14 and 15, adjusters 20 and 21 along the back strap and loops 22 and 23 engageable in D rings 24 and 25 of enhancers 26 and 27 which may have the configuration shown in FIG. 2 or FIG. 5.

The enhancers 26 and 27 have connectors 28 and 29 releasably joining them to the cups 12 and 13.

Figure 2:
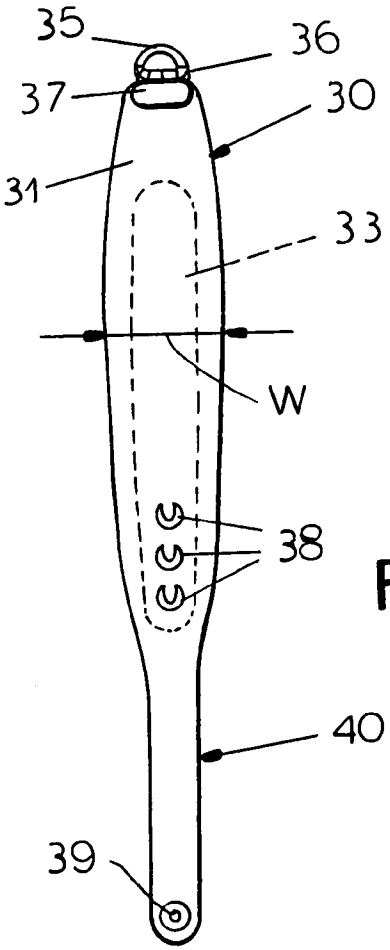
FIG. 2 is an elevational view of a cup enhancer for a maternity or sports brassiere according to the invention.

As can be seen in FIG. 2, the enhancer comprises a seamless laminated strip 30 formed from coextensive upper and lower layers 31 and 32, welded together and sandwiching a cushion layer 33 between them. The strip 30 is of a width W which can be greater than the width w of a shoulder strap 34 to which the strip 30 is connected by a ring 35.

The ring 35 can be opened and closed to the side 36 and is connected to a pair of aprons 37 sandwiching the strip 30 between them and welded thereto. The openable and closeable D ring can correspond to the D ring disclosed in our copending application Ser. No. 11/113,354 filed 22 Apr. 2005 and incorporated herein in its entirety by reference. The strip 30 can be formed with a row of female fasteners 38 which can be welded to the strip so that toward the body, the backs of the fasteners are hidden or not hidden as desired. These fasteners can cooperate with male combination press and hook fasteners, e.g. as shown at 39. Fasteners of this type are described in our copending application Ser. No. 10/978,238 filed 29 Oct. 2004 and incorporated herein by reference.

Figure 4:
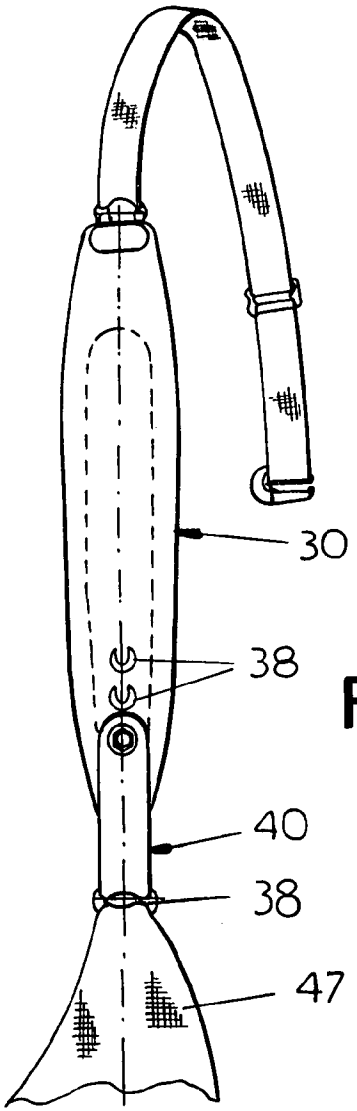
FIG. 4 is a view similar to FIG. 3 showing the enhancer in place on a sports brassiere.
Figure 3:
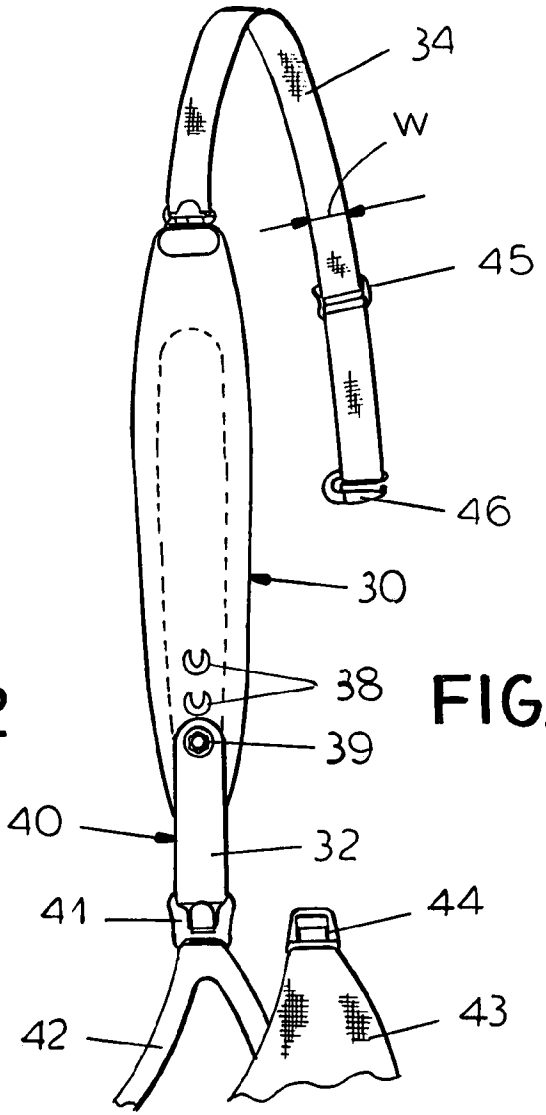
FIG. 3 is a view similar to FIG. 2 showing the enhancer in place on a maternity brassiere.

The fastener 39 is formed at the end of a length 40 of strap extending from the strip 30 and adapted to be passed through an arm or loop so that the male fastener 39 can engage one of the female fasteners 38 as shown in FIGS. 3 and 4.

As can be seen from FIG. 3, the strip 30 can be used in a maternity brassiere between the shoulder strap 34 and the body of the brassiere by passing the strap portion 40 through the hook 41 and the undercup 42. The outer flap or overcup 43 can be attached to the hook 41 by the mating fastener member 44 and be released to expose the breast for nursing. The male press and hook fastener 39 can be engaged in one or a number of the female fasteners 38 to adjust the position of the cup relative to the strap, e.g. higher in the case of the maternity breast and lower in the case of a full breast.

The strap 34 has a length adjuster 45 of conventional configuration and a hook 46 allowing it to be engaged detachably in a loop along the back of the brassiere.

FIG. 4 shows the strip 30 applied to a sports brassiere whose cup 47 has a loop or eye 48 through which the strap 40 is passed and selectively engaged in one or another of the female fasteners 38.

Figure 5:
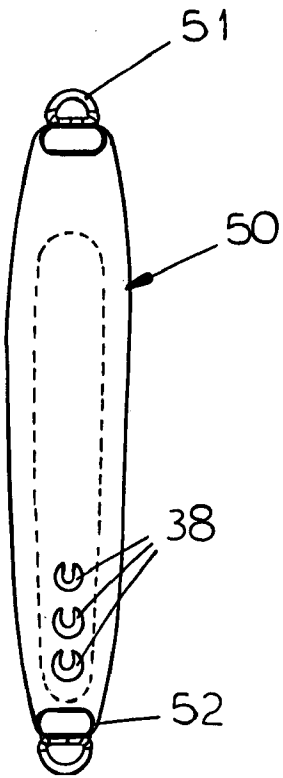
FIG. 5 is a view similar to FIG. 2 of another embodiment of the enhancer of the invention.

FIG. 5 shows a breast enhancer 50 in accordance with a second embodiment in which that unit is provided with the openable and closeable D-rings 51 and 52 at both ends and, of course, the female fasteners 38 previously described.

Figure 6:
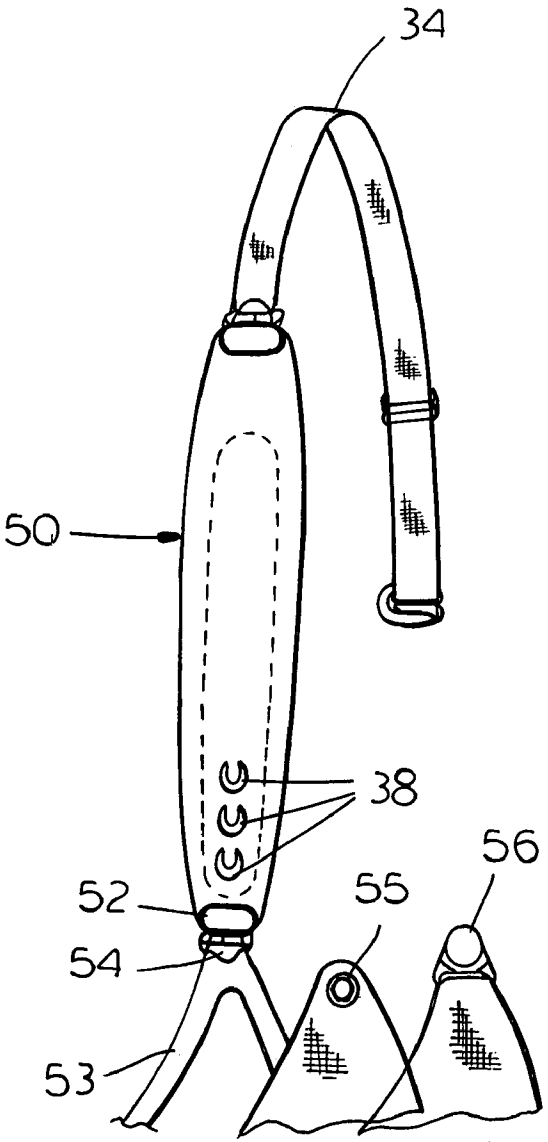
FIG. 6 is a view similar to FIG. 3 illustrating a feature of the invention.

In FIG. 6, the breast enhancer 50 is provided between the shoulder strap and the undercup 53 to which the connector 52 is joined by a loop 54 on the undercup. The upper flap of the maternity brassiere can have a male press and hook fastener 55 or 56 which can engage in one or another of the female fasteners 38.

Figure 8:
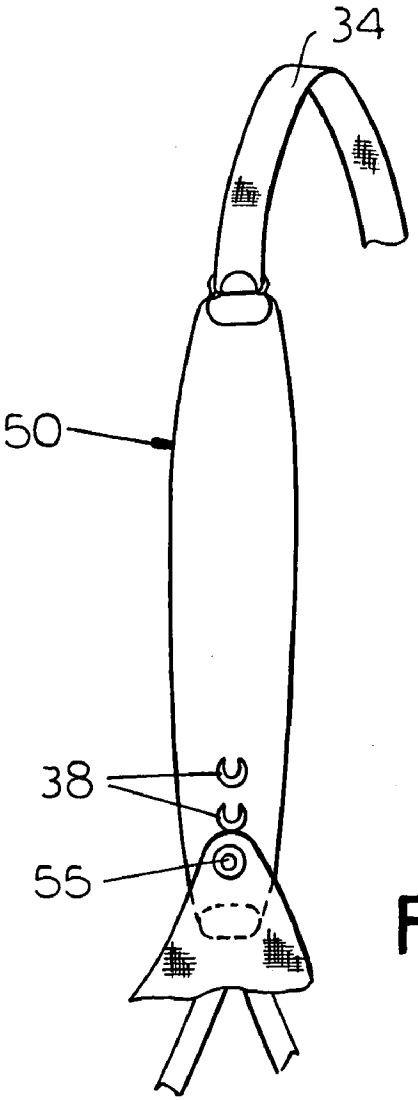
FIGS. 7 and 8 are views showing the flap of nursing brassieres connected to different press and hook final fasteners of the enhancer.
Figure 7:
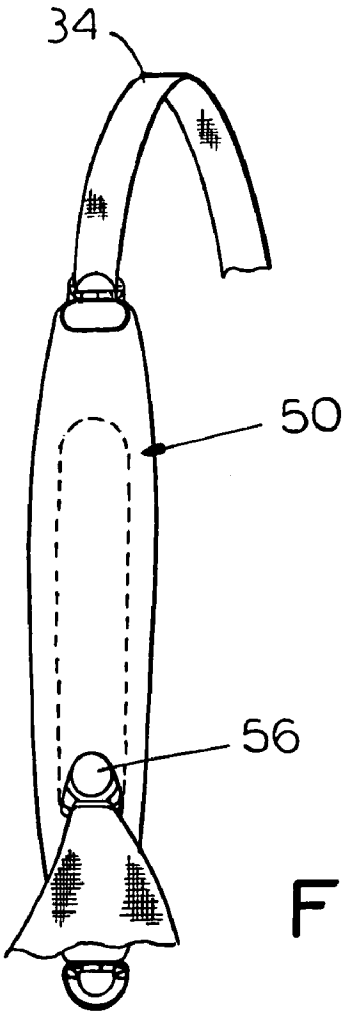

In FIG. 7, the fastener 56 is shown engaged in the uppermost female fastener 38 while in FIG. 8 the fastener 55 is shown engaged in the lowermost fastener 38.

We claim:

1. A brassiere comprising:

a brassiere body formed with two cups;

a back portion extending rearwardly from opposite sides of said brassiere body and adapted to extend around a back of a wearer;

respective shoulder straps adapted to support said cups and connectable to said back portion; and a respective cup enhancer between an attachment point on each shoulder strap and an attachment point on the respective cup, each of said enhancers comprising an elongated flexible strip of a width greater than that of the respective shoulder strap and formed at one end with a connector detachably engageable with the attachment point of the respective strap and at an opposite end with a connector detachably engageable with the attachment point of the respective cup, at least one of said connectors comprising a ring secured to the respective attachment point and a length of strap fixed to the respective strip, looped through the respective ring, and secured to a surface of the respective strip at a selected one of a plurality of locations thereon.

2. The brassiere defined in claim 1 wherein said length of strap is integral with said strip.

3. The brassiere defined in claim 1 wherein said length of strap has at a free end a male combination press and hook fastener selectively engageable in one of a row of female fasteners provided on said strip.

4. The brassiere defined in claim 3 wherein each ring has an openable and closeable side.

5. The brassiere defined in claim 4 wherein said strip is provided at an end opposite said length of strap with a ring with an openable and closeable side for attachment to the attachment point of the respective shoulder strap.

6. A brassiere comprising:

a brassiere body formed with two cups;

a back portion extending rearwardly from opposite sides of said brassiere body and adapted to extend around a back of a wearer;

respective shoulder straps adapted to support said cups and connectable to said back portion; and a respective cup enhancer between an attachment point on each shoulder strap and an attachment point on the respective cup, each of said enhancers comprising an elongated flexible strip of a width greater than that of the respective shoulder strap and formed at one end with a connector detachably engageable with the attachment point of the respective strap and at an opposite end with a connector detachably engageable with the attachment point of the respective cup, each of said strips being provided with a row of female fasteners selectively engageable by a male combination press and hook fastener on the respective cup.

7. The brassiere defined in claim 6 wherein at least one of the connectors of each strip comprises a ring with an openable and closeable side on at least one end of the respective strip.

8. The brassiere defined in claim 7 wherein each of the connectors comprises a ring with an openable and closeable side on a respective end of the respective strip.

9. A brassiere comprising:

a brassiere body formed with two cups;

a back portion extending rearwardly from opposite sides of said brassiere body and adapted to extend around a back of a wearer;

respective shoulder straps adapted to support said cups and connectable to said back portion; and a respective cup enhancer between an attachment point on each shoulder strap and an attachment point on the respective cup, each of said enhancers comprising an elongated flexible strip of a width greater than that of the respective shoulder strap and formed at one end with a connector detachably engageable with the attachment point of the respective strap and at an opposite end with a connector detachably engageable with the attachment point of the respective cup, each of said strips having a reduced-width end portion provided with a row of female fasteners selectively engageable by a male combination press and hook fastener and with a cushioning layer extending along said row.

10. The brassiere defined in claim 1 wherein each of said strips has a pair of coextensive outer layers welded together.

11. The brassiere defined in claim 10, further comprising a cushioning layer between said outer layers and extending over at least part of the length of the respective strip.

12. In combination with a brassiere, a cup enhancer comprising an elongated flexible strip formed at one end with a connector detachably engageable with a shoulder strap of a brassiere and at an opposite end with a connector detachably engageable with a respective cup of the brassiere, at least one of said connectors comprising a ring and a reduced-width length of strap looped through the ring and carrying a fastener secured to any of a plurality of complementary fasteners mounted a surface of said strip at a selected one of a plurality of locations thereon, whereby the cup enhancer can be shortened to provide uplift for the respective cup.

13. The cup enhancer defined in claim 12 wherein said length of strap is integral with said strip.

14. The cup enhancer defined in claim 12 wherein said length of strap has at a free end a male combination press and hook fastener selectively engageable in one of a row of female fasteners provided on said strip.

15. The cup enhancer defined in claim 14 wherein each ring has an openable and closeable side.

16. The cup enhancer defined in claim 15 wherein said strip is provided at an end opposite said length of strap with a ring with an openable and closeable side for attachment to the attachment point of the respective shoulder strap.

17. In combination with a brassiere, a cup enhancer comprising an elongated flexible strip formed at one end with a connector detachably engageable with a shoulder strap of a brassiere and at an opposite end with a connector detachably engageable with a respective cup of the brassiere, said strip being provided with a row of female fasteners selectively engageable by a male combination press and hook fastener, whereby the cup enhancer can be shortened to provide uplift for the respective cup.

18. The cup enhancer defined in claim 17 wherein said strip is provided with a ring with a respective openable and closeable side at each end.

* * * * *